US005877591A

United States Patent [19]

Nagata et al.

[11] Patent Number: 5,877,591

[45] Date of Patent: Mar. 2, 1999

[54] ARC TUBE FOR DISCHARGE LAMP DEVICE

[75] Inventors: Akihiro Nagata; Shinichi Irisawa, both of Shizuoka, Japan

[73] Assignee: Koito Manufacturing Co., Ltd., Tokyo, Japan

[21] Appl. No.: 889,448

[22] Filed: Jul. 8, 1997

[30] Foreign Application Priority Data

Jul. 10, 1996 [JP] Japan ..... 8-180290

[51] Int. Cl.[6] ..... H01J 61/36; H01J 9/32

[52] U.S. Cl. ..... 313/634; 313/623; 445/22; 445/26; 220/2.1 R; 220/2.2

[58] Field of Search ..... 313/634, 623; 220/2.1 R, 2.2; 445/22, 26, 53

[56] References Cited

U.S. PATENT DOCUMENTS

| | | | |
|---|---|---|---|
| 4,396,857 | 8/1983 | Danko | 313/634 |
| 4,959,587 | 9/1990 | Schug | 313/634 |
| 5,128,589 | 7/1992 | Dakin | 313/634 |
| 5,277,639 | 1/1994 | Nagata et al. | 445/26 |
| 5,286,227 | 2/1994 | Numajiri et al. | 445/26 |
| 5,505,648 | 4/1996 | Nagasawa et al. | 445/26 |

FOREIGN PATENT DOCUMENTS

| | | |
|---|---|---|
| 0 408 981 | 1/1913 | European Pat. Off. . |
| 2423054 | 4/1979 | France . |
| 54-85577 | 7/1979 | Japan . |
| 61-024125 | 2/1986 | Japan . |
| 1061127 | 2/1965 | United Kingdom . |

*Primary Examiner*—Nimeshkumar D. Patel
*Attorney, Agent, or Firm*—Sughrue, Mion, Zinn, Macpeak & Seas, PLLC

[57] ABSTRACT

An arc tube for a discharge lamp device comprises: a cylindrical glass tube made of glass, having linear extension portions, each having an opening portion at an end, and a spherically swollen portion formed between the linear extension portions; and electrode assemblies inserted in the respective linear extension portions, wherein neck portions are formed in boundaries between the spherically swollen portion and the linear extension portions so that the glass in each of the linear extension portions side is prevented from flowing into the inside of the spherically swollen portion when the linear extension portions are pinch-sealed.

6 Claims, 7 Drawing Sheets

RELATIONSHIP BETWEEN INNER DIAMETER OF NECK PORTION AND VARIATION OF AMOUNT OF ELECTRODE ECCENTRICITY

| INNER DIAMETER OF NECK PORTION | 0.6 | 0.7 | 1.0 | 1.5 |
|---|---|---|---|---|
| n | 17 | 40 | 9 | 35 |
| $\bar{x}$ (mm) | 0.00 | 0.02 | −0.06 | 0.05 |
| $\sigma n-1$ (mm) | 0.08 | 0.19 | 0.21 | 0.27 |

RELATIONSHIP BETWEEN INNER DIAMETER OF NECK PORTION AND VARIATIONS OF LUMINOUS FLUX, COLOR TEMPERATURE AND CHROMATICITY

| INNER DIAMETER OF NECK PORTION | n | LUMINOUS FLUX (ℓm) | COLOR TEMPERATURE (k) | CHROMATICITY x | CHROMATICITY y |
|---|---|---|---|---|---|
| 0.6 | 15 | 108 | 133 | 0.0049 | 0.0020 |
| 0.7 | 40 | 139 | 171 | 0.0060 | 0.0037 |
| 1.0 | 8 | 171 | 249 | 0.0089 | 0.0043 |
| 1.5 | 38 | 189 | 300 | 0.0099 | 0.0052 |

ARC TUBE FOR DISCHARGE LAMP DEVICE

BACKGROUND OF THE INVENTION

The present invention relates to an arc tube for a discharge lamp device.

FIG. 8 shows a conventional discharge lamp device. The discharge lamp device has a structure in which front and rear end portions of an arc tube 5 are supported by a pair of lead supports 3 and 4 projecting forward from an electrically insulating base 2. The arc tube 5 has a structure in which a closed glass bulb 5*a* is formed between a pair of pinch seal portions 5*b*, 5*b* such that a pair of electrode rods 6, 6 are disposed so as to be opposite to each other in tire glass bulb 5*a* by the pinch seal portions 5*b*, 5*b* respectively and luminous materials are enclosed in the glass bulb 5*a*. A piece of molybdenum foil 7 integrally connected to the electrode rod 6 and a lead wire 8 is enclosed in each of the pinch seal portions 5*b*. A circular arc generated between the electrode rods 6, 6 in the closed glass bulb 5*a* emits light to thereby provide a turned-on state.

A method for producing the arc tube 5 is disclosed, for example, in Japanese Patent Application Laid-open No. Hei. 6-231729. As shown in FIG. 9(*a*), first, an electrode assembly A constituted by an electrode rod 6, a piece of molybdenum foil 7 and a lead wire 8 to which the rod 6 and the foil 7 are integrally connected is inserted into a cylindrical glass tube W from one opening end side of the glass tube W. The glass tube W has a spherically swollen portion $w_2$ formed in the middle of the glass tube W, that is, between linear extension portions $w_1$. A position $P_1$ near the spherically swollen portion $w_2$ is primarily pinch-sealed. Then, as shown in FIG. 9(*b*), luminous materials P, etc., introduced into the spherically swollen portion $w_2$ from the other opening end side of the glass tube W. Then, as shown in FIG. 9(*c*), another electrode assembly A is inserted and, at the same time, a position $P_2$ near the spherically swollen portion $w_2$ is heated and secondarily pinch-sealed while the spherically swollen portion $w_2$ is cooled by liquid nitrogen so that the luminous materials are not vaporized. In this manner, the spherically swollen portion $w_2$ is sealed hermetically, so that an arc tube 5 having a tipless closed glass bulb 5*a* is finished.

Another method for producing the arc tube is disclosed, for example, in Japanese Patent Application Laid-open No. Hei. 5-174785. As shown in FIG. 10(*a*), first, an exhaust tube $w_3$ is integrally connected to a spherically swollen portion $w_2$ of a cylindrical glass tube W to produce a T-shaped glass tube. Then, as shown in FIG. 10(*b*), a pair of electrode assemblies A are inserted from the respective opening end sides of linear extension portions $w_1$. As shown in FIG. 10(*c*), portions of the respective linear extension portions $w_1$ near the spherically swollen portion $w_2$ are pinch-sealed (as indicated by arrows). Incidentally, FIG. 10(*c*) is a bottom view of the T-shaped glass tube shown in FIG. 10(*b*). Then, as shown in FIG. 10(*d*), luminous materials P, etc., are introduced through the exhaust tube $w_3$. Then, as shown in FIG. 10(*e*), the exhaust tube $w_3$ is tipped off, so that an arc tube having a tipped and closed glass bulb is finished.

In the aforementioned conventional arc tubes, however, luminous flux, light color, etc., vary largely in accordance with the produced arc tubes and the proportion defections are increased correspondingly.

The present inventor has examined the cause of the high percentage of defections. As a result, it has been found that the cause is in that, in the step of pinch-sealing the linear extension portions $w_1$ of the glass tube W, a glass material in the pinched linear extension portion $w_1$ side flows into the spherically swollen portion $w_2$ side to thereby make the internal shape of the closed glass bulb 5*a* distorted or make the electrodes (electrode rods 6, 6) eccentric from each other with an amount of eccentricity L as shown in an enlarged view in FIG. 11.

That is, as shown in FIGS. 12(*a*) and 12(*b*), a heated region of a linear glass tube is shaped up spherically by blow molding to thereby obtain the cylindrical glass tube W used in the production of an arc tube. Accordingly, neck portions 9 as shown in enlargement in FIG. 13 are formed in the boundaries between the linear extension portions $w_1$ and the spherically swollen portion $w_2$. The inner diameter $d_9$ of the neck portions 9 is, however, formed to be several times as large as the diameter of spherical portions 6*a* at the ends of the electrode rods 6 so that the spherical portions 6*a* can be inserted into the spherically swollen portion $w_2$ smoothly. Accordingly, the clearance between the electrode rods 6 and the neck portions 9 is so large that when the glass material is pinched in the pinch-sealing step, the heated and softened glass material in the linear extension portion side flows into the spherically swollen portion $w_2$ side (see the arrow in FIG. 11) to make the internal shape of the closed glass bulb 5*a* distorted or make the counter electrodes eccentric from each other.

Particularly, in order to produce an arc tube 10 having a tipless closed glass bulb 12, the glass tube W must be secondarily pinch-sealed while the spherically swollen portion $w_2$ is cooled so that the introduced luminous materials, etc., are not vaporized. Accordingly, the inner pressure of the spherically swollen portion $w_2$ becomes negative at the time of pinch-sealing. As a result, the pinched glass material is apt to be sucked into the spherically swollen portion $w_2$ correspondingly. The problem that the internal shape of the closed glass bulb 5*a* becomes distorted or the counter electrodes become eccentric arises remarkably in the arc tube 10 having such a tipless closed glass bulb.

Therefore, the present inventor conducted experiments and made considerations upon the aforementioned problems in the prior art. As a result, the present inventor confirmed that the aforementioned problems could be solved if the inner diameter of the neck portions 9 between the linear extension portions $w_1$ and the spherically swollen portion $w_2$ in the glass tube W was reduced. Thus, the present inventor has achieved the present invention.

SUMMARY OF THE INVENTION

The present invention is based on the aforementioned problems and the findings of the present inventor. An object of the present invention is to provide an arc tube for a discharge lamp device in which not only the internal shape of a closed glass bulb is prevented from becoming distorted but also counter electrodes are prevented from becoming eccentric at the time of pinch-sealing.

In order to achieve the foregoing and other objects, according to the present invention, provided is an arc tube for a discharge lamp device in which electrode assemblies inserted into a cylindrical glass tube having a spherically swollen portion formed in the lengthwise middle of the glass tube from opening portions respectively at opposite ends of the glass tube are disposed so that insertion-end portions of the electrode assemblies are axially opposite to each other in the spherically swollen portion, and boundary regions between the spherically swollen portion and linear extension portions of the glass tube are pinch-sealed to thereby form a closed glass bulb containing counter electrodes and luminous materials enclosed therein, characterized in that neck portions are formed in boundaries between the spherically swollen portion and the linear extension portions in the glass tube so that a glass material in each of the linear extension portions side is prevented from flowing into the inside of the spherically swollen portion when the linear extension portions are pinch-sealed. Accordingly, the small-inner-diameter neck portions formed between the linear extension portions and the spherically swollen portion in the glass tube serve as guides for keeping the electrode rods in predetermined positions, and the neck portions prevent the pinched and softened glass material in the linear extension portion side from flowing into the inside of the spherically swollen portion side.

As for the specific size of the neck portions, in the case where the electrode rods constituting counter electrodes are formed to have a diameter $d_1$, the radial clearance between the neck portions and the electrode rods is preferably selected to be not smaller than 0.05 mm in order to smoothly insert the electrode rods into the spherically swollen portion. Furthermore, in order to keep the electrode rods straight and prevent the pinched and softened glass material in the linear extension portions from flowing into the inside of the spherically swollen portion at, the time of pinch-sealing, the radial clearance between the neck portions and the electrode rods is preferably selected to be not larger than 0.5 mm. That is, the inner diameter d of the neck portions is preferably selected to be in the following range:

$$d_{1+}0.05\ \text{mm} \leqq d \leqq d_{1+}0.5\ \text{mm}.$$

Further, in the case where spherical portions having an outer diameter $d_2$ larger than the diameter $d_1$ of the electrode rods are formed at ends of the electrode rods respectively, the radial clearance between the neck portions and the spherical portion is preferably selected to be not smaller than 0.05 mm in order to smoothly insert the electrode rods into the spherically swollen portion. Furthermore, in order to keep the electrode rods straight and prevent the pinched and softened glass material from flowing into the inside of the spherically swollen portion at the time of pinch-sealing, the radial clearance between the neck portions and the electrode rods is preferably selected to be not larger than 0.5 mm. That is, the inner diameter d of the neck portions is preferably selected to be in the following range:

$$d_{2+}0.05\ \text{mm} \leqq d \leqq d_{1+}0.5\ \text{mm}.$$

BRIEF DESCRIPTION OF THE DRAWINGS

FIG. 3(*a*) is a view for schematically explaining the step of forming the spherically swollen portion; FIG. 3(*b*) is a view for explaining the step of forming the spherically swollen portion; FIG. 3(*c*) is a view for explaining the step of forming the spherically swollen portion; FIG. 3(*d*) is a view for explaining the step of forming the neck portions; and FIG. 3(*e*) is a view for explaining the step of forming the neck portions;

FIG. 9(*a*) is a view for explaining the primary pinch-sealing step; FIG. 9(*b*) is a view for explaining the luminous material introducing step; and FIG. 9(*c*) is a view for explaining the secondary pinch-sealing step;

DETAILED DESCRIPTION OF THE PREFERRED EMBODIMENTS

The embodiments of the present invention will be described below on the basis.

Figure 1:
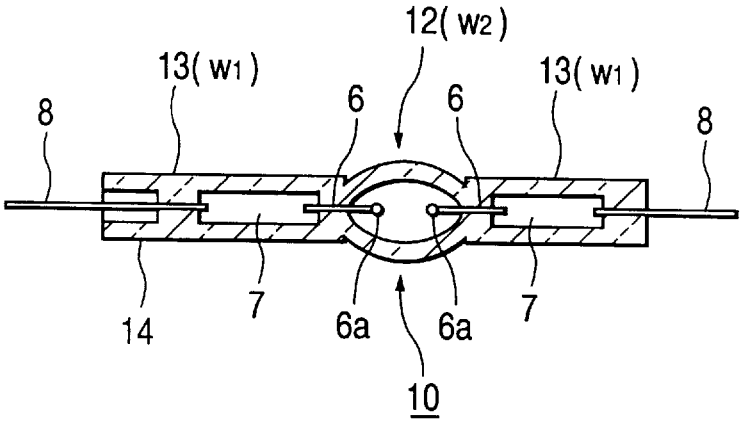
FIG. 1 is a vertical sectional view of an arc tube as an embodiment of the present invention.
Figure 2:
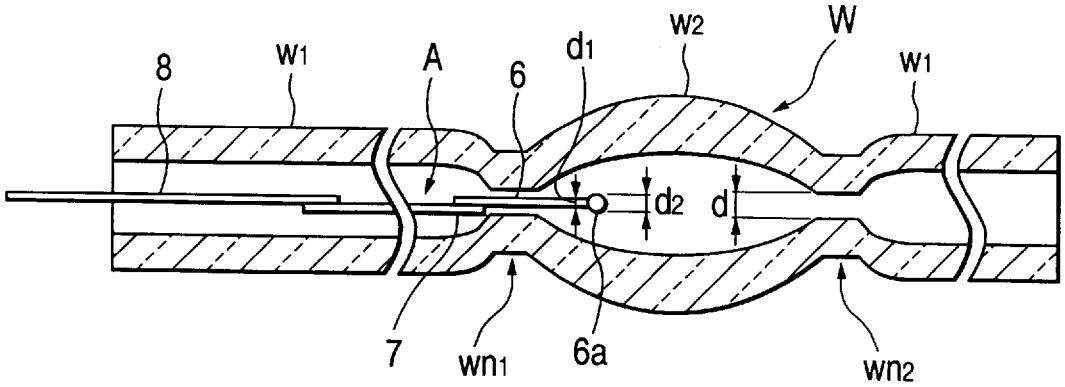
FIG. 2 is an enlarged sectional view of a glass tube for the arc tube.
Figure 3A:
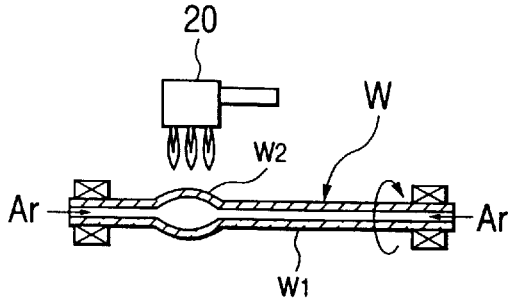
FIGS. 3(*a*) to 3(*e*) are views for explaining a process for producing the glass tube.
Figure 3B:
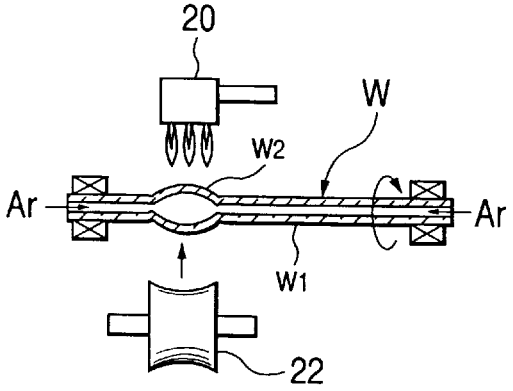
Figure 3C:
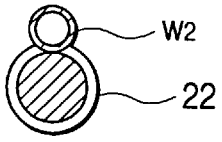
Figure 3D:
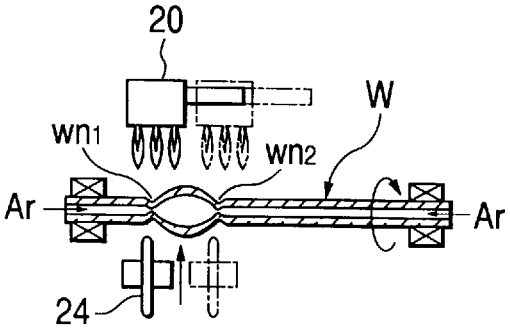
Figure 3E:
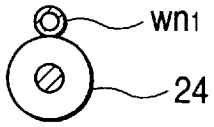

FIGS. 1 to 3(*e*) show an embodiment of the present invention. FIG. 1 is a vertical sectional view of an arc tube as an embodiment of the present invention. FIG. 2 is an enlarged sectional view of a glass tube for the arc tube. FIGS. 3(*a*) to 3(*e*) are views for explaining a process for producing the glass tube.

Figure 8:
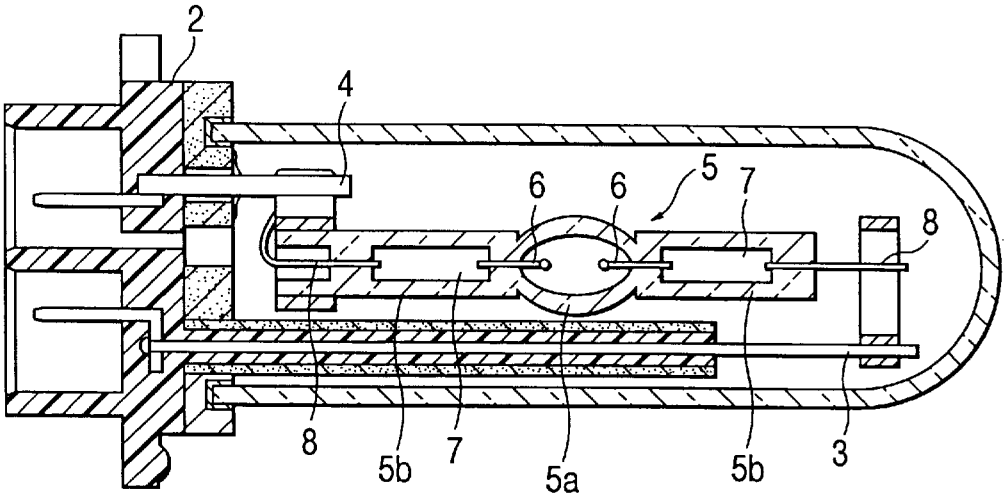
FIG. 8 PRIOR ART
FIG. 8 is a sectional view of a conventional discharge lamp device.

In these drawings, a discharge lamp device to which an arc tube 10 is attached has the same structure as the conventional structure shown in FIG. 8, and the description thereof will be therefore omitted here.

The arc tube 10 has a structure in which a round-pipe-like quartz glass tube W having a spherically swollen portion $w_2$ formed in the longitudinal middle of a linear extension portion $w_1$ is pinch-sealed at portions near the spherically swollen portion $w_2$ so that pinch seal portions 13, 13 rectangularly shaped in cross section are formed in opposite end portions of an ellipsoidal tipless closed glass bulb 12 forming a discharge space. Starting rare gas, mercury and metal halide (hereinafter referred to as "luminous materials, etc.") are enclosed in the closed glass bulb 12.

A pair of tungsten electrode rods 6, 6 constituting discharge electrodes are disposed in the closed glass bulb 12 so as to be opposite to each other. The electrode rods 6, 6 are connected to pieces of molybdenum foil 7 enclosed in the pinch seal portions 13, respectively. Molybdenum lead wires 8 connected to the pieces of molybdenum foil 7 are led out from the end portions of the pinch seal portions 13, respectively. The rear end side lead wire 8 passes through a round-pipe-like portion 14, which is a pinchless seal portion, and extends to the outside.

The external appearance of the arc tube 10 shown in FIG. 1 does not seem different apparently from that of the conventional arc tube 5 shown in FIG. 8. As shown in FIG. 2, however, neck portions $wn_1$, $wn_2$ each having a predetermined inner diameter are, however, preliminarily formed in boundaries between the spherically swollen portion $w_2$ and the respective linear extension portions $w_1$ of the glass tube W used in a pinch seal step in a process for producing the arc tube. The glass tube W in which the neck portions $wn_1$, $wn_2$ each having a predetermined inner diameter are formed is pinch-sealed so as to constitute an arc tube.

Further, the inner diameter of each of the neck portions $wn_1$, $wn_2$ is formed so as to be large enough so that an electrode assembly A including integrally connected an electrode rod 6, a piece of molybdenum foil 7 and a lead wire 8 can be smoothly inserted up to a predetermined position in the glass tube W. Further, when the linear extension portions $w_1$ are pinched in a state in which the piece of electrode assemblies A are inserted respectively, not only the electrode rods 6 are kept straight by the presence of the neck portions $wn_1$, $wn_2$ , respectively, but also a softened glass material in each of the pinched linear extension portions $w_1$ is prevented from flowing into the spherically swollen portion $w_2$. As a result, there is obtained a structure in which the internal shape of the tipless closed glass bulb 12 is proper so that counter discharge electrodes are formed with less amount of eccentricity.

That is, if the inner diameter d of each of the neck portions $wn_1$, $wn_2$ between the spherically swollen portion $w_2$ and the linear extension portions $w_1$of the glass tube W used in the pinch seal step is selected to satisfy the condition of $$d_{2+}0.05\ \text{mm} \leqq d \leqq d_{1+}0.5\ \text{mm}.$$

in which $d_1$ is the thickness of each of the electrode rods 6 constituting the counter electrodes, and $d_2$ is the outer diameter of a spherical portion 6*a* formed at an end of each of the electrode rods 6, the electrode rods 6 can be smoothly inserted into the spherically swollen portion $w_2$ as well as the internal shape of the sealed spherically swollen portion $w_2$ (closed glass bulb 12) is prevented from becoming distorted so that the counter electrodes (electrode rods 6, 6) can be made slight in eccentricity.

Incidentally, the glass tube W shown in this embodiment is designed so that the linear extension portion $w_1$ has an external diameter of 4.0 mm and an inner diameter of 2.0 mm, each of the electrode rods 6 constituting the electrodes has a diameter $d_1$ of 0.2 mm and the spherical portion 6*a* at an end of each of the electrode rods 6 has an outer diameter $d_2$ of 0.4 mm whereas each of the neck portions $wn_1$, $wn_2$ has an inner diameter d in a range of from 0.45 mm to 0.7 mm, inclusively.

A process for producing a glass tube W for the arc tube having such a tipless closed glass bulb 12 as shown in FIG. 1 will be described below with reference to FIG. 3.

As shown in FIG. 3(*a*), first, a predetermined lengthwise position of a uniform-diameter cylindrical glass tube W is heated by a burner 20 so as to be softened while the glass tube W is rotated. At the same time, while an inert gas (such as Ar gas, or the like) is supplied into the glass tube to keep the inside of the tube pressurized, the glass tube is dammed axially by using a glass lathe not shown. Thus, a spherically swollen portion $w_2$ is formed in the middle of the linear extension portion $w_1$.

Further, as shown in FIGS. 3(*b*) and 3(*c*), while the inside of the glass tube W is kept pressurized, the contour of the spherically swollen portion $w_2$ is shaped up by a molding revolving roller 22. Incidentally, FIG. 3(*c*) is a sectional view in the position of the spherically swollen portion $w_2$ in FIG. 3(*b*).

Then, as shown in FIGS. 3(*d*) and 3(*e*), the neck portions $wn_1$, $wn_2$ between the spherically swollen portion $w_2$ and the linear extension portions $w_1$ are heated successively by the burner 20, while the inside of the glass tube W is kept pressurized. Portions softened by heating are shaped up successively by means of a neck portion molding revolving roller 24 so that the inner diameter d of each of the neck portions $wn_1$, $wn_2$ is selected to be in a predetermined range (of from 0.45 mm to 0.7 mm, inclusively). In this manner, a glass tube W for the arc tube having the neck portions $wn_1$, $wn_2$ formed between the spherically swollen portion $w_2$ and the linear extension portions $w_1$ is produced.

After electrode assemblies A are inserted into the glass tube W and luminous materials, etc., are introduced into the glass tube W, the linear extension portions $w_1$ are pinch-sealed. As a result, an arc tube having a tipless closed glass bulb 12 containing the electrode rods 6, 6 disposed so as to be opposite to each other, and the luminous materials, etc., enclosed therein can be produced. This method is the same as the conventional method shown in FIG. 9.

Figure 9A:
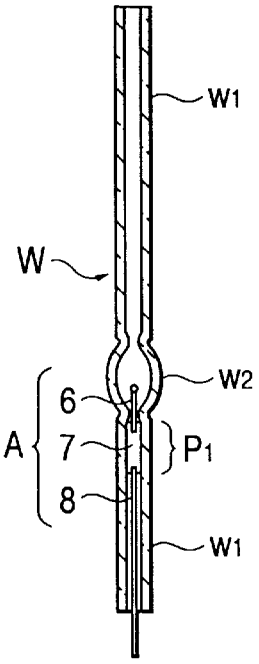
PRIOR ART FIG. 9(a)
FIGS. 9(*a*) to 9(*c*) are views for explaining a process for producing the conventional arc tube.
Figure 9B:
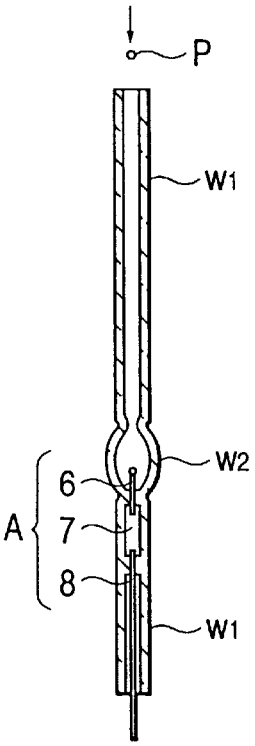
PRIOR ART FIG. 9(b)
Figure 9C:
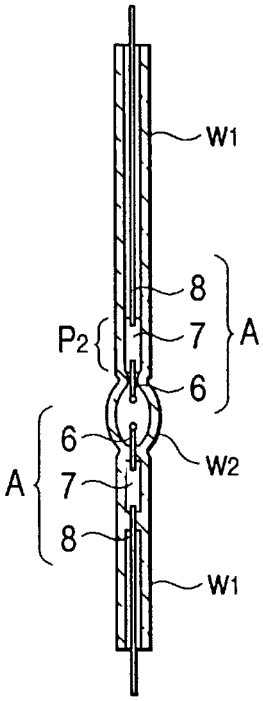
PRIOR ART FIG. 9(c)
Figure 10A:
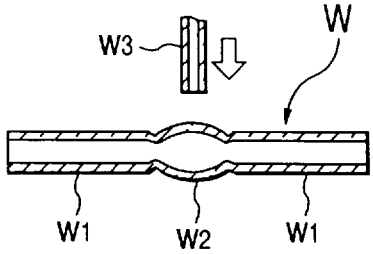
FIG. 10(a) PRIOR ART
FIGS. 10(*a*) to 10(*e*) are views for explaining another process of producing the conventional arc tube.
Figure 10B:
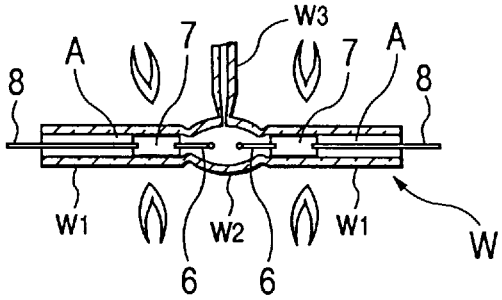
FIG. 10(b) PRIOR ART
Figure 10C:
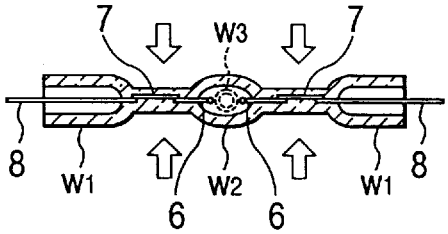
FIG. 10(c) PRIOR ART
Figure 10D:
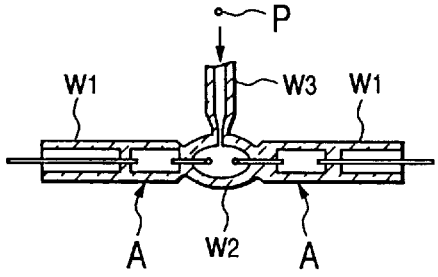
FIG. 10(d) PRIOR ART
Figure 10E:
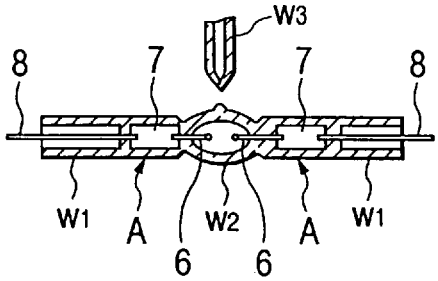
FIG. 10(e) PRIOR ART
Figure 11:
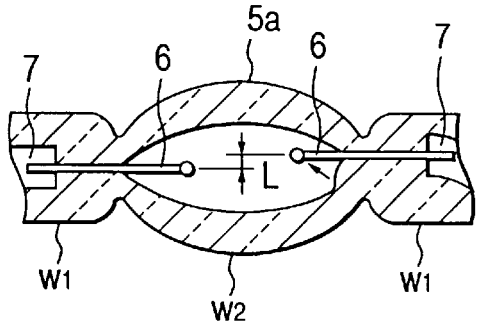
FIG. 11 PRIOR ART
FIG. 11 is a view for explaining problems in the conventional arc tube.
Figure 12A:
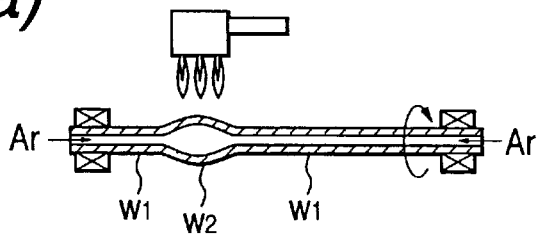
FIG. 12(a) PRIOR ART
FIGS. 12(*a*) and 12(*b*) are views for explaining a process of producing a glass tube for the conventional arc tube.
Figure 12B:
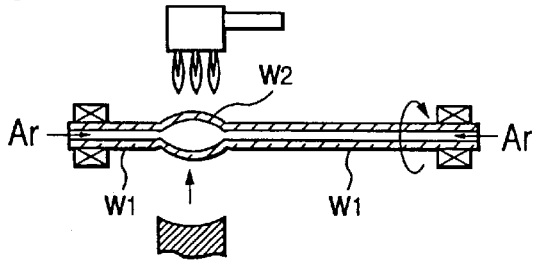
FIG. 12(b) PRIOR ART
Figure 13:
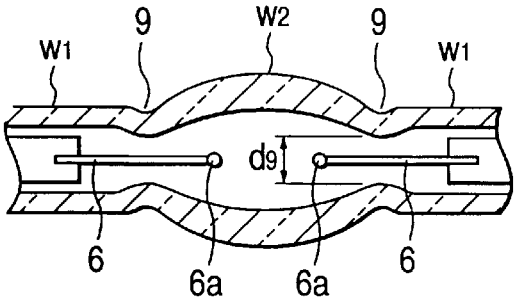
FIG. 13 PRIOR ART
FIG. 13 is a view for explaining problems in the glass tube for the conventional arc tube.

That is, as shown in FIG. 9(*a*), first, an electrode assembly A is inserted into the glass tube W from the lower opening end and held in a predetermined position while the glass tube w is held vertically. A position $P_1$ of the linear extension portion $w_1$ near the spherically swollen portion $w_2$ is heated and primarily pinch-sealed. Then, as shown in FIG. 9(*b*), luminous materials P, etc., are introduced into the spherically swollen portion $w_2$ from the upper opening end. Then, as shown in FIG. 9(*c*), the another electrode assembly A is inserted and, at the same time, a position $P_2$ of the linear extension portion $w_1$ near the spherically swollen portion $w_2$ is heated and secondarily pinch-sealed while the spherically swollen portion $w_2$ is cooled by liquid nitrogen so that the luminous materials P, etc., are not vaporized. Thus, the spherically swollen portion $w_2$ is sealed hermetically, so that the arc tube 10 having the tipless closed glass bulb 12 is finished.

In the primary pinch-sealing step shown in FIG. 9(*a*), an axially pressing force acts on the glass material in the linear extension portion $w_1$ side because the glass material is pinched. The small-diameter neck portion wn, formed in the boundary between the spherically swollen portion $w_2$ and the linear extension portion $w_1$, however, approaches the outer circumference of the electrode rod 6 so that the linear extension portion $w_1$ serves as a guide for keeping the electrode rod 6 straight at the time of the pinching of the linear extension portion $w_1$ and also as a barrier for preventing the pinched glass material from moving to the spherically swollen portion $w_2$ side. Accordingly, there is no defect that the internal shape of the molded closed glass bulb 12 becomes distorted or the electrode rod 6 is inclined.

In the primary pinch-sealing step shown in FIG. 9(*c*), an axially pressing force acts on the glass material in the linear extension portion $w_1$ side because the glass material is pinched, and a negative pressure generated in the spherically swollen portion $w_2$ acts on the glass material because the spherically swollen portion $w_2$ is cooled. The small-diameter neck portion $wn_2$ formed in the boundary between the spherically swollen portion $w_2$ and the linear extension portion $w_1$, however, approaches the outer circumference of the electrode rod 6 so that the neck portion serves as a guide for keeping the electrode rod 6 straight at the time of the pinching of the linear extension portion $w_1$ and also as a barrier for preventing the pinched glass material from moving to the spherically swollen portion $w_2$ side. Accordingly, there is no defect that the internal shape of the molded closed glass bulb 12 becomes distorted or the electrode rod 6 is inclined, that is, the counter electrodes (electrode rods 6, 6) become eccentric.

Figures 4, 5:
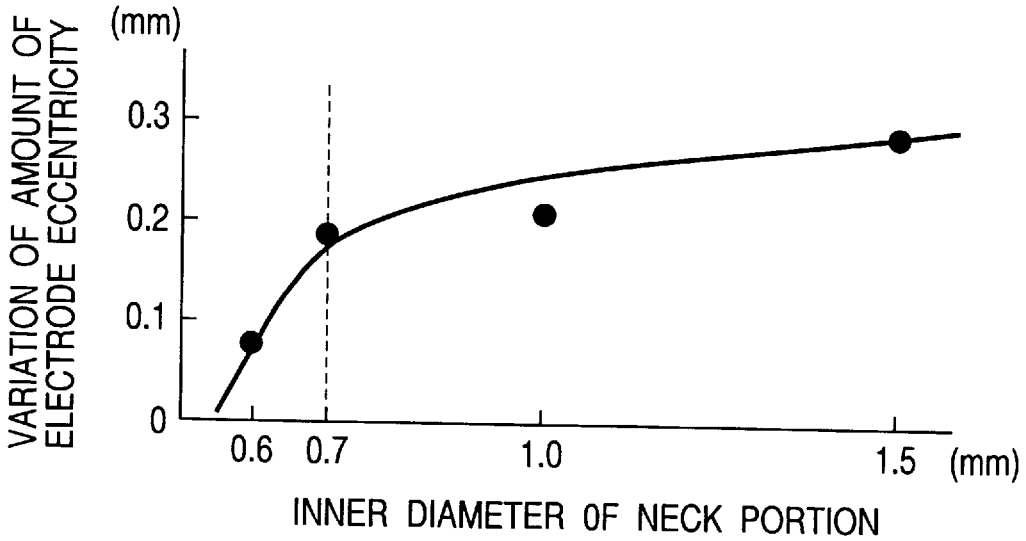
FIG. 4 is a view showing, as a table, the relation between the inner diameter of the neck portions of the glass tube and the variation in the amount of eccentricity of the electrodes.
FIG. 5 is a graph showing the relation between the inner diameter of the neck portions of the glass tube and the variation in the amount of eccentricity of the electrodes.
Figures 6, 7:
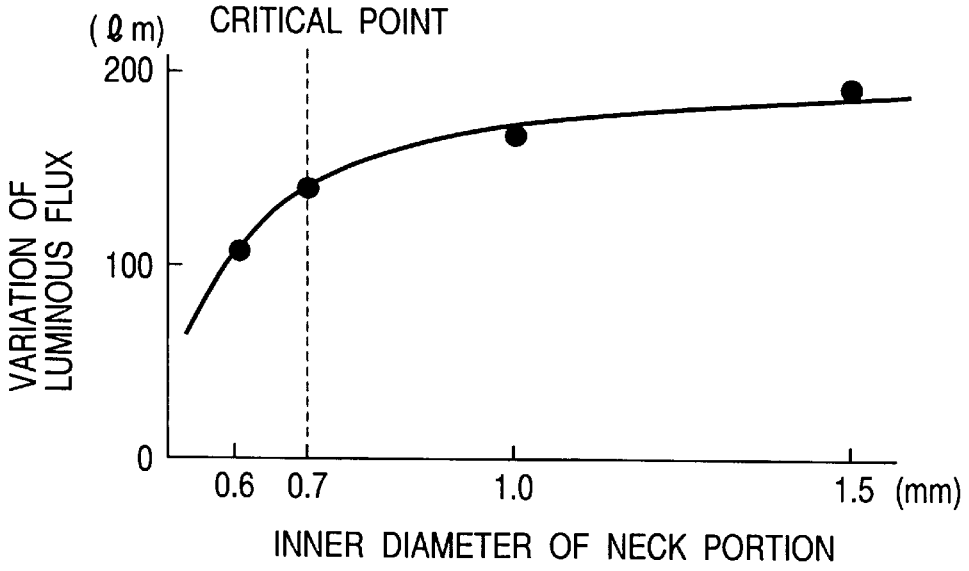
FIG. 6 is a view showing, as a table, the relations between the inner diameter of the neck portions of the glass tube and the variations in luminous flux, color temperature and chromaticity.
FIG. 7 is a graph showing the relation between the inner diameter of the neck portions of the glass tube and the variation in luminous flux.

FIGS. 4 to 7 show data concerning variations in the amount of eccentricity between counter electrodes, the value of luminous flux, etc., in tipless closed glass bulbs which are obtained when arc tubes are produced by using glass tubes W having the inner diameters d of the neck portions $wn_1$, $wn_2$ selected to be 0.6 mm, 0.7 mm, 1.0 mm and 1.5 mm, respectively. FIG. 4 is a view showing, as a table, the relation between the inner diameter of the neck portions and the variation of the amount of electrode eccentricity in the glass tube. FIG. 5 is a graph showing the relation between the inner diameter of the neck portions and the variation of the amount of electrode eccentricity in the glass tube. FIG. 6 is a view showing, as a table, the relations between the inner diameter of the neck portions and the variations of luminous flux, color temperature and chromaticity (x, y) in the glass tube. FIG. 7 is a graph showing the correlation between the inner diameter of the neck portions and the variation of the value of luminous flux in the glass tube. Also the relation between the inner diameter of the neck portions and the variation of color temperature and the relation between the inner diameter of the neck portions and the variation of chromaticity (x, y) exhibit substantially the same tendency as the correlation between the inner diameter of the neck portions and the variation of the value of luminous flux shown in FIG. 7. Incidentally, in FIG. 4, n shows the number of samples, x shows the average of the amount of eccentricity, and $\sigma_{n--1}$ shows a standard deviation (the quantity of variation) in each case.

As is obvious from these drawings, the amount of electrode eccentricity changes suddenly and the quantity of variation of luminous flux changes suddenly with the sudden change of the amount of electrode eccentricity when the inner diameter of the neck portions $wn_1$, $wn_2$ of the glass tube W for the arc tube exceeds 0.7 mm (the radial clearance between the inner circumferential surface of the neck portions $wn_1$, $wn_2$ and the electrode rods 6 exceeds 0.5 mm). When the inner diameter of the neck portions $wn_1$, $wn_2$ of the glass tube W is not larger than 0.7 mm (the radial clearance between the inner circumferential surface of the neck portions $wn_1$, $wn_2$ and the electrode rods 6 is not larger than 0.5 mm), the variations in the amount of eccentricity of the electrodes and the value of luminous flux are very small so that the variations in color temperature and chromaticity (x, y) are also very small. That is, in the arc tube using the glass tube having the inner diameter of the neck portions $wn_1$, $wn_2$ selected to be not larger than 0.7 mm, the variations in luminous flux, color temperature and chromaticity (x, y) are small so that predetermined accuracy is guaranteed.

Although the aforementioned embodiment has been explained about the arc tube having counter electrodes constituted by electrode rods 6 having spherical portions 6*a* of outer diameter $d_2$ integrally formed at their ends respectively, the invention can be also applied to an arc tube having counter electrodes constituted only by electrode rods of diameter $d_1$. In this case, the inner diameter d of the neck portions is preferably selected to be in the following range:

$$d_1+0.05\ \text{mm} \leqq d \leqq d_1+0.5\ \text{mm}.$$

Although the aforementioned embodiment has been explained about the arc tube 10 having a tipless closed glass bulb 12, the invention can be also applied to an arc tube having a tipped and closed glass bulb as shown in FIGS. 10(*a*) to 10(*e*).

As is obvious from the above description, in the arc tube for the discharge lamp device according to the present invention, there is no defect that the internal shape of the glass bulb becomes distorted or the electrodes become eccentric when the closed glass bulb is pinch-sealed. Accordingly, there is provided an arc tube which always has an appropriate volume and in which eccentricity between counter electrodes is avoided so that predetermined stable luminous flux is obtained.

What is claimed is:

1. An arc tube for a discharge lamp device comprising:

a cylindrical glass tube made of glass, having linear extension portions, each having an opening portion at an end, and a spherically swollen portion formed between said linear extension portions; and electrode assemblies inserted in the respective linear extension portions, wherein neck portions are formed in boundaries between the spherically swollen portion and the linear extension portions, and the linear extension portions are pinch-sealed, wherein the electrode assemblies comprise a pair of electrode rods each having a predetermined diameter $d_1$, and wherein an inner diameter d of each of the neck portions is within the following range:

$$d_1+0.05\ \text{mm} \leqq d \leqq d_1+0.5\ \text{mm}.$$

2. An arc tube for a discharge lamp device comprising:

a cylindrical glass tube made of glass, having linear extension portions, each having an opening portion at an end, and a spherically swollen portion formed between the linear extension portions; and electrode assemblies inserted in the respective linear extension portions, wherein neck portions are formed in boundaries between the spherically swollen portion and the linear extension portions, and the linear extension portions are pinch-sealed, wherein the electrode assemblies comprise:

a pair of electrode rods each having a predetermined diameter $d_1$; and spherical portions, formed at ends of said rods, respectively, each of said spherical portions having an outer diameter $d_2$ larger than said predetermined diameter $d_1$, and wherein an inner diameter d of each of the neck portions is within the following range:

$$d_2+0.05\ \text{mm} \leqq d \leqq d_1+0.5\ \text{mm}.$$

3. A method for making an arc tube for a discharge lamp device comprising the steps of:

providing electrodes, each having a electrode rod having a predetermined diameter $d_1$ to constitute counter electrodes;

making neck portions in boundaries between a spherically swollen portion and linear extension portions of a cylindrical glass tube, wherein an inner diameter d of each of the neck portions has the following range, $$d_1+0.05\ \text{mm} \leqq d \leqq d_1+0.5\ \text{mm};$$

inserting the electrode assemblies in the respective linear extension portions of the cylindrical glass tube; and pinch-sealing the linear extension portions of the cylindrical glass tube.

4. A method for making an arc tube for a discharge lamp device comprising the steps of:

providing electrodes, each having a electrode rod having a predetermined diameter $d_1$ to constitute counter electrodes and a spherical portion having an outer diameter $d_2$ larger than the diameter of each of the electrode rods are formed at ends of the electrode rods respectively;

making neck portions in boundaries between a spherically swollen portion and linear extension portions of a cylindrical glass tube, wherein an inner diameter d of each of the neck portions has the following range, $$d_2+0.05\ \text{mm} \leqq d \leqq d_1+0.5\ \text{mm};$$

inserting the electrode assemblies in the respective linear extension portions of the cylindrical glass tube; and pinch-sealing the linear extension portions of the cylindrical glass tube.

5. A cylindrical glass tube made of glass for a discharge lamp device comprising:

linear extension portions, each having an opening portion at an end;

a spherically swollen portion formed between the linear extension portions; and neck portions formed in boundaries between the spherically swollen portion and the linear expansion portions, the linear extension portions being pinch-sealed, wherein an inner diameter d of each of the neck portions is within the following range:

$$d_1+0.05\ \text{mm} \leqq d \leqq d_1+0.5\ \text{mm},$$

where $d_1$ represents a diameter of electrode rods of electrode assemblies to be inserted, respectively, into the linear extension portions.

6. A cylindrical glass tube made of glass for a discharge lamp device comprising:

linear extension portions, each having an opening portion at an end;

a spherically swollen portion formed between the linear extension portions; and neck portions formed in boundaries between the spherically swollen portion and the linear expansion portions, the linear extension portions being pinch-sealed, wherein an inner diameter d of each of the neck portions is within the following range:

$$d_2+0.05\ \text{mm} \leqq d \leqq d_1+0.5\ \text{mm},$$

where $d_1$ represents a diameter of electrode rods of electrode assemblies to be inserted into the linear extension portions, and $d_2$ represents an outer diameter of spherical portions formed at ends of the electrode rods, respectively.

* * * * *